US008747212B1

(12) United States Patent
Perrone et al.

(10) Patent No.: US 8,747,212 B1
(45) Date of Patent: Jun. 10, 2014

(54) NUMBER PICKING GAME WITH INTEGRATED SPORTS PROJECTILES

(75) Inventors: Rick Perrone, Darien, CT (US); George Stadnick, New York, NY (US); Kal Patel, Stamford, CT (US)

(73) Assignee: Tournament One, Corp., Stamford, CT (US)

( * ) Notice: Subject to any disclaimer, the term of this patent is extended or adjusted under 35 U.S.C. 154(b) by 1036 days.

(21) Appl. No.: 11/944,353

(22) Filed: Nov. 21, 2007

Related U.S. Application Data

(60) Provisional application No. 60/866,880, filed on Nov. 22, 2006, provisional application No. 60/866,881, filed on Nov. 22, 2006.

(51) Int. Cl.
*A63F 9/00* (2006.01)

(52) U.S. Cl.
USPC ..... 463/18

(58) Field of Classification Search
USPC ..... 463/2, 4, 5, 18–20
See application file for complete search history.

(56) References Cited

U.S. PATENT DOCUMENTS 5,651,735 A * 7/1997 Baba ..... 463/18
5,813,911 A * 9/1998 Margolin ..... 463/19
6,270,407 B1 * 8/2001 Dodge ..... 463/18
6,398,644 B1 * 6/2002 Perrie et al. ..... 463/18
6,824,465 B2 * 11/2004 Luciano, Jr. ..... 463/18
7,470,186 B2 * 12/2008 Cannon ..... 463/18
7,837,547 B2 * 11/2010 Cannon ..... 463/16
7,846,016 B2 * 12/2010 Bozeman ..... 463/17
8,113,939 B2 * 2/2012 Cannon ..... 463/18
8,251,799 B2 * 8/2012 Rommerdahl et al. ..... 463/20
8,333,648 B2 * 12/2012 Tarantino ..... 463/18
2003/0064772 A1 * 4/2003 Tempest et al. ..... 463/16
2004/0048659 A1 * 3/2004 Seelig et al. ..... 463/25
2005/0037832 A1 * 2/2005 Cannon ..... 463/18
2005/0215309 A1 * 9/2005 Tarantino ..... 463/20
2005/0227753 A1 * 10/2005 Luciano, Jr. ..... 463/18
2006/0003829 A1 * 1/2006 Thomas ..... 463/20
2006/0079317 A1 * 4/2006 Flemming et al. ..... 463/25
2006/0084496 A1 * 4/2006 Jaffe et al. ..... 463/20
2007/0184887 A1 * 8/2007 Cannon ..... 463/16

* cited by examiner

*Primary Examiner* — Seng H Lim
(74) *Attorney, Agent, or Firm* — Muskin & Cusick LLC

(57) ABSTRACT

A number picking game such as keno which incorporates sports animations into the visual presentation when numbers are picked by a random number generator. A player indicates the player's selection of numbers. Randomly generated numbers are determined. Animated athletes can cast a projectile onto a grid of numbers, the projectile colliding with a number on the grid and thus picking that number. The animated athletes will thus pick all of the randomly generated numbers while they are playing their sports. The player's selected numbers and the randomly generated numbers are compared and an award is made to the player based on a number of matches.

11 Claims, 14 Drawing Sheets

NUMBER PICKING GAME WITH INTEGRATED SPORTS PROJECTILES

CROSS REFERENCE TO RELATED APPLICATIONS

This application claims benefit to provisional application 60/866,880 filed Nov. 22, 2006, which is incorporated by reference herein in its entirety. This application also claims benefit to provisional application 60/866,881 Nov. 22, 2006, which is incorporated by reference herein in its entirety.

BACKGROUND OF THE INVENTION

1. Field of the Invention

The inventive concept relates to a number picking game such as a keno or lottery game which incorporates projectile animations in order to facilitate the presentation of randomly generated numbers to the player.

2. Description of the Related Art

Keno is a casino game which involves a player predicting which numbers will be randomly picked by the casino (either electronically or using a mechanical apparatus such as using keno balls).

What is needed, is a more exciting presentation of presenting the random numbers that are picked to the player.

SUMMARY OF THE INVENTION

It is an aspect of the present invention to provide an entertaining number picking display.

The above aspects can be obtained by a method that includes (a) displaying a grid of numbers; (b) receiving a wager from a player; (c) receiving a set of player picked numbers picked by a player; (d) determining a set of computer generated numbers randomly generated by a computer; (e) for each particular number from the set of computer generated numbers, performing: (f) animating a projectile from a starting point to the particular number in the grid of numbers; (g) completing the animating and marking the number in the grid as being one of the computer generated numbers; (g) determining a number of matches between the set of player picked numbers and the set of computer generated numbers; and (i) determining if the player has earned an award based on the number of matches, and if so, then paying the award to the player, an amount of the award being based on the number of matches.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE ART

Further features and advantages of the present invention, as well as the structure and operation of various embodiments of the present invention, will become apparent and more readily appreciated from the following description of the preferred embodiments, taken in conjunction with the accompanying drawings of which:

DESCRIPTION OF THE PREFERRED EMBODIMENTS

Figure 1:
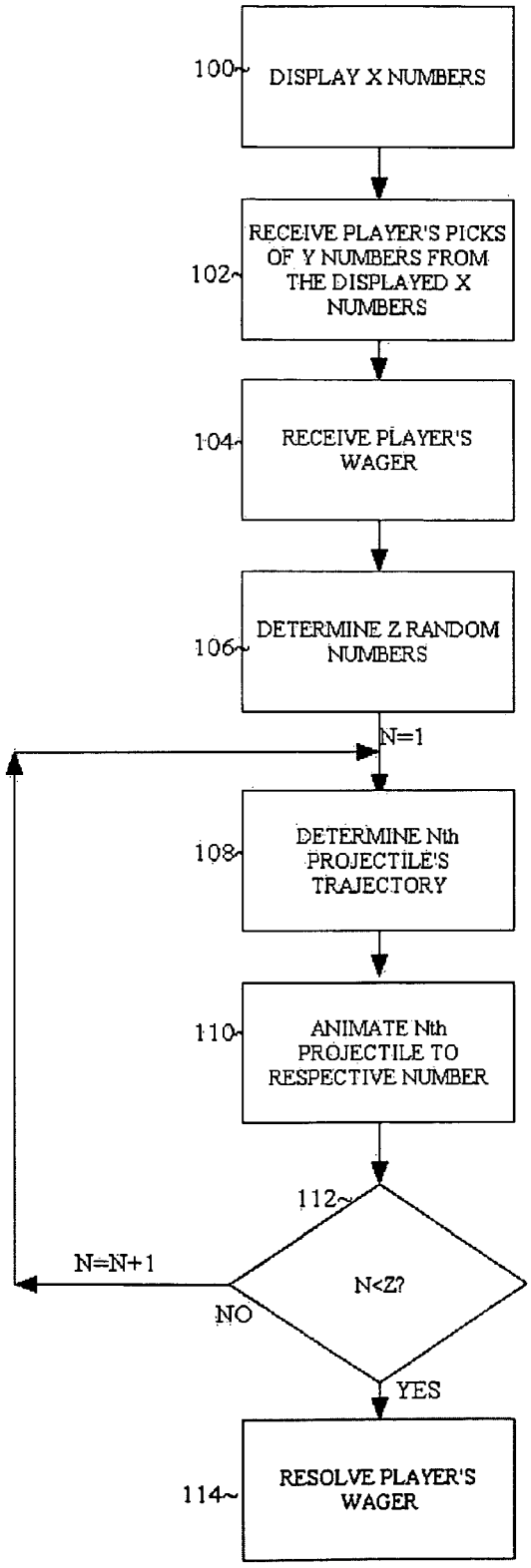
FIG. 1 is a flowchart illustrating an exemplary method of implementing a number picking animation, according to an embodiment.

Reference will now be made in detail to the presently preferred embodiments of the invention, examples of which are illustrated in the accompanying drawings, wherein like reference numerals refer to like elements throughout.

The general inventive concept relates to a number picking game such as keno. The game of keno is known in the art and is described in U.S. Pat. No. 5,192,076 and in U.S. patent publication number 2006/0281522, both documents of which are incorporated by reference herein in their entireties. The methods described herein also apply to lottery games as well as keno.

In keno, a player is presented with a grid of X numbers. The player makes a wager (e.g., $1). The player picks Y numbers out of these X (Y being less than X), typically at random (although players can also pick numbers such as their "lucky numbers"). The computer generates Z random numbers (Z being less than X). Now the numbers that the player picked are compared to the randomly generated numbers that the computer generated to determine the number of matches. It is then determined if the player wins an award based on the number of matches.

In the prior art, the randomly generated numbers by the computer are picked and simply identified to the player. This can be considered a boring presentation. In an embodiment of the present inventive concept, the randomly generated numbers are identified to the player using a meaningful and entertaining animation tying the randomly generated numbers into a sports activity.

FIG. 1 is a flowchart illustrating an exemplary method of implementing a number picking animation, according to an embodiment.

The method can begin with operation 100, which displays X numbers. The numbers can be displayed for example in a grid on an output device such as a touch screen monitor. X can be any number for example 80.

From operation 100, the method can proceed to operation 102 which receives the player's picks of Y numbers from the grid. The player can indicate his or her selection of particular numbers simply by touching the desired numbers on the grid. Y can be any number, for example 15.

From operation 102, the method can proceed to operation 104, which receives the player's wager. This can be done as known in the art, for example the player placing cash into an electronic gaming device and pressing buttons on the electronic gaming device to communicate the device that the player is placing a wager.

From operation 104, the method can proceed to operation 106, which determines (generates) Z randomly generated numbers by a computer. The randomly numbers determined in this operation are not yet displayed to the player, in order to create a more suspenseful experience.

From operation 106, the method can proceed to operation 108, which starts at n=1 (the first randomly generated number from operation 106).

In operation 108, a projectile is determined which will collide with the Nth randomly generated number. For example, a ball (projectile) can be launched (hit, kicked, etc.) from part of the screen (a starting point such as an athlete) and the ball will follow a trajectory (for example a parabolic path) until it collides with the Nth randomly generated number on the number grid. A trajectory for a projectile can be determined in numerous ways, for example using a table or other data structure. For example, a number on the grid can be associated with one or more starting points. Given a number on the grid and a starting point, trajectory information can then be indexed. Trajectory information can come in many forms, for example it can be a sequential list of x,y coordinates that the projectile will follow until it reaches the destination of the number on the grid. The trajectory information can also be parameters in an equation (e.g., a parabolic equation) which designates the x,y coordinate of the projectile as a function of time. The animation from a starting point to a number on the grid should take a brief amount of time, for example one second.

From operation 108, the method can proceed to operation 101, which animates the Nth projectile to collide with the Nth randomly generated number on the number grid. The number grid will then identify that the ball had collided with that number. Each number that each ball collides with on the grid are the randomly generated numbers generated by the computer in operation 106. When a projectile collides with a number on the grid, that number is marked to indicate that it is one of the randomly generated numbers (generated in operation 106). If that number has also been selected by the player (in operation 102), then that number can be specially marked to indicate it is a matched number.

From operation 110, the method can then proceed to operation 112, which determines whether N<Z, that is, whether the computer has displayed all of the randomly generated numbers yet as projectiles. If not, then the method can increment N and return to operation 108. Note from FIG. 1 that N does not take on a value of 1 again (this only happens the first time operation 108 is reached).

If the determination in operation 112 determines that N is not smaller than Z (e.g., N=Z), then all of the randomly generated numbers determined in operation 106 have been outputted to the player and the method can then proceed to operation 114 which resolves the player's wager placed in operation 104. A number of matches (matched numbers) between the players picks (in operation 102) and the computer's determined random numbers (in operation 106) is determined. Using a paytable, it can be determined whether the player wins an award based on a number of matches, and how much. If the player is entitled to an award, then he is paid the award, otherwise the player is paid nothing (and the player has already made his or her wager which is lost).

It is noted that the operations in FIG. 1 can be performed in any order. For example, the player's wager can be accepted first, and then the player picks can be received. The computer can generate its random numbers at any point in time (even immediately before the projectile animation).

Figure 2:
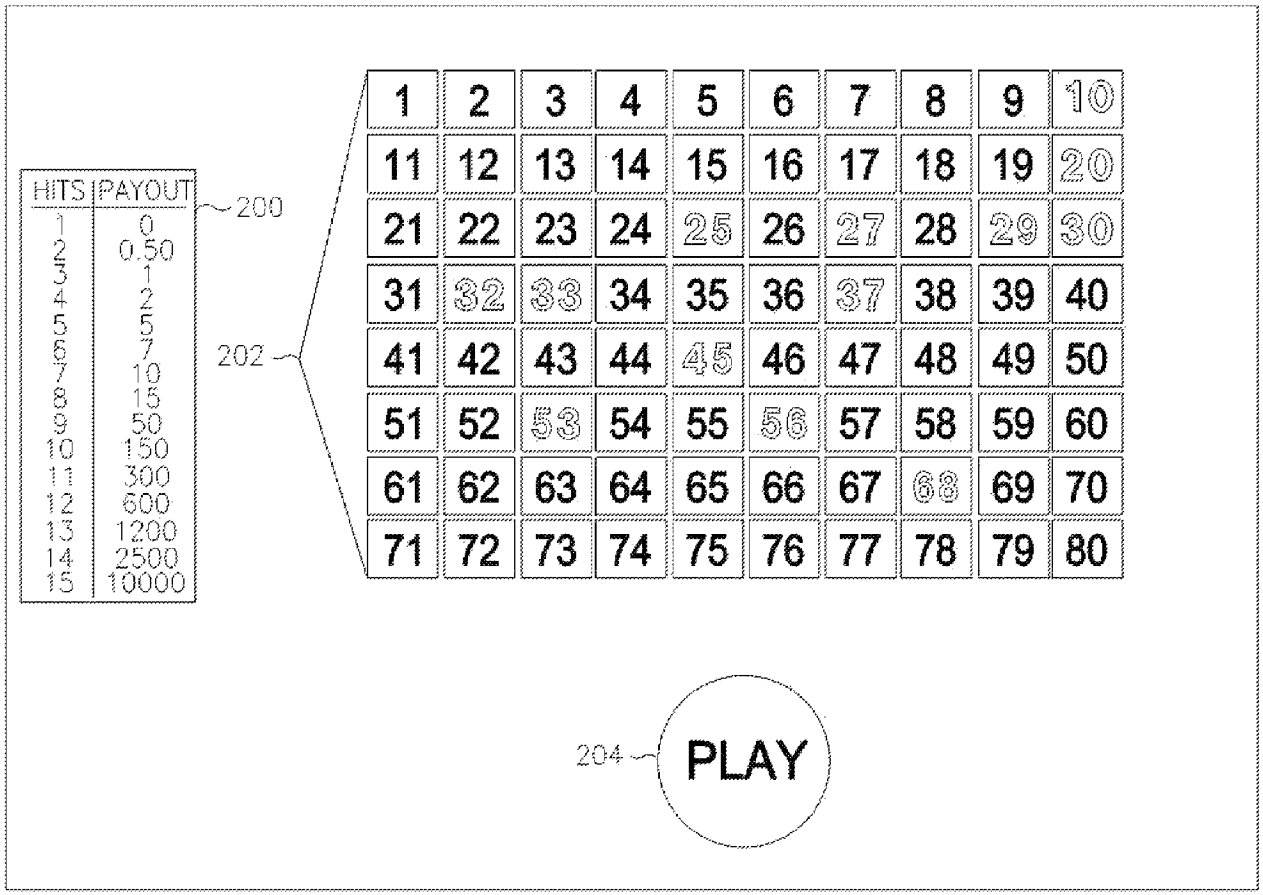
FIG. 2 is a screen shot illustrating a number grid and a skeet theme, according to an embodiment.

FIG. 2 is a screen shot illustrating a number grid and a skeet theme, according to an embodiment.

A number grid 202 displays 80 different numbers that the player can pick. A paytable 200 is used to determine whether the player wins, and how much. A play button 204 is used by the player to indicate that the player has completed picking the player's numbers and now wishes the computer to generate its random numbers. When the player pushes the play button 204, the game can progress to eventually display FIG. 3. Note that the numbers that the player picked are displayed in white while the unselected numbers are displayed in black. In this example the player has picked 15 numbers (10, 14, 20, 25, 27, 29, 30, 32, 33, 37, 45, 53, 56, 59, 68).

Figure 3:
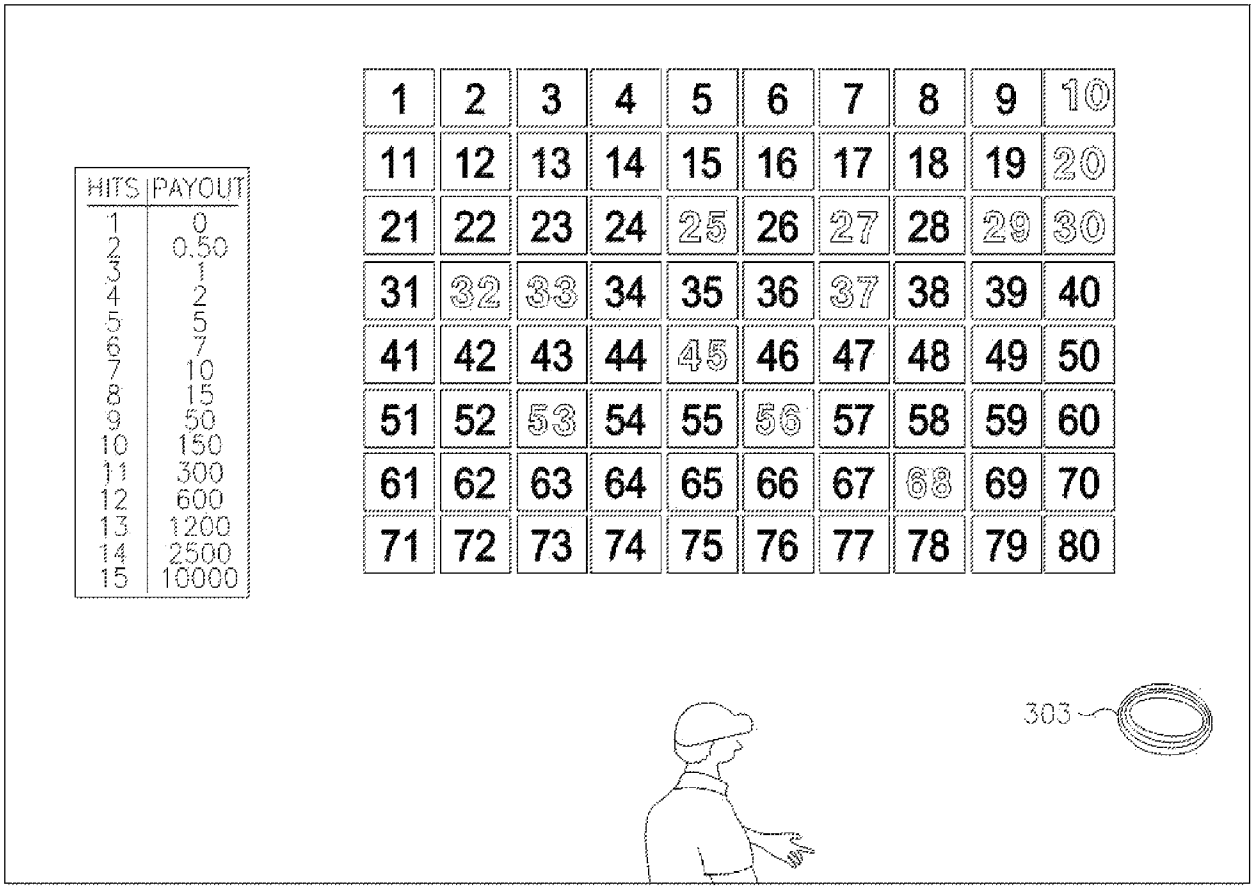
FIG. 3 is a screen shot illustrating a projectile being animated, according to an embodiment.

FIG. 3 is a screen shot illustrating a projectile being animated, according to an embodiment. Note a projectile 303 is being animated. The projectile in this example, is a skeet target, although of course any other type or projectile can be used. The projectile 303 is animated and can follow a parabolic (curved) path to one of the numbers on the grid. The projectile 303 continues to move in a curved path to the illustration in FIG. 4.

Figure 4:
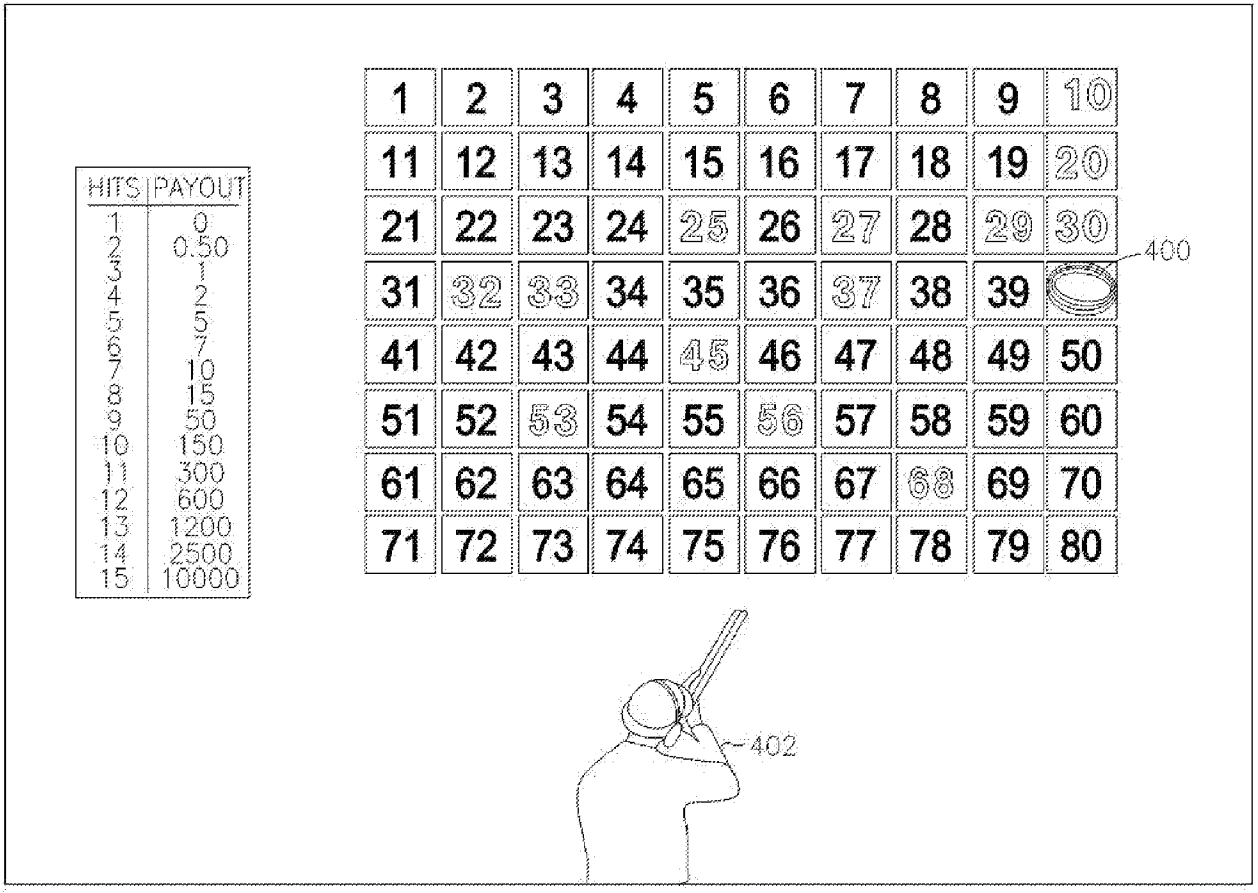
FIG. 4 is a screen shot illustrating the projectile colliding into a number, according to an embodiment.

FIG. 4 is a screen shot illustrating the projectile colliding into a number, according to an embodiment.

Note the projectile 400 is headed towards number 19 (the first random number generated by the computer). The animation continues to eventually display FIG. 5. A skeet shooter 402 is preparing to shoot the projectile 400.

Figure 5:
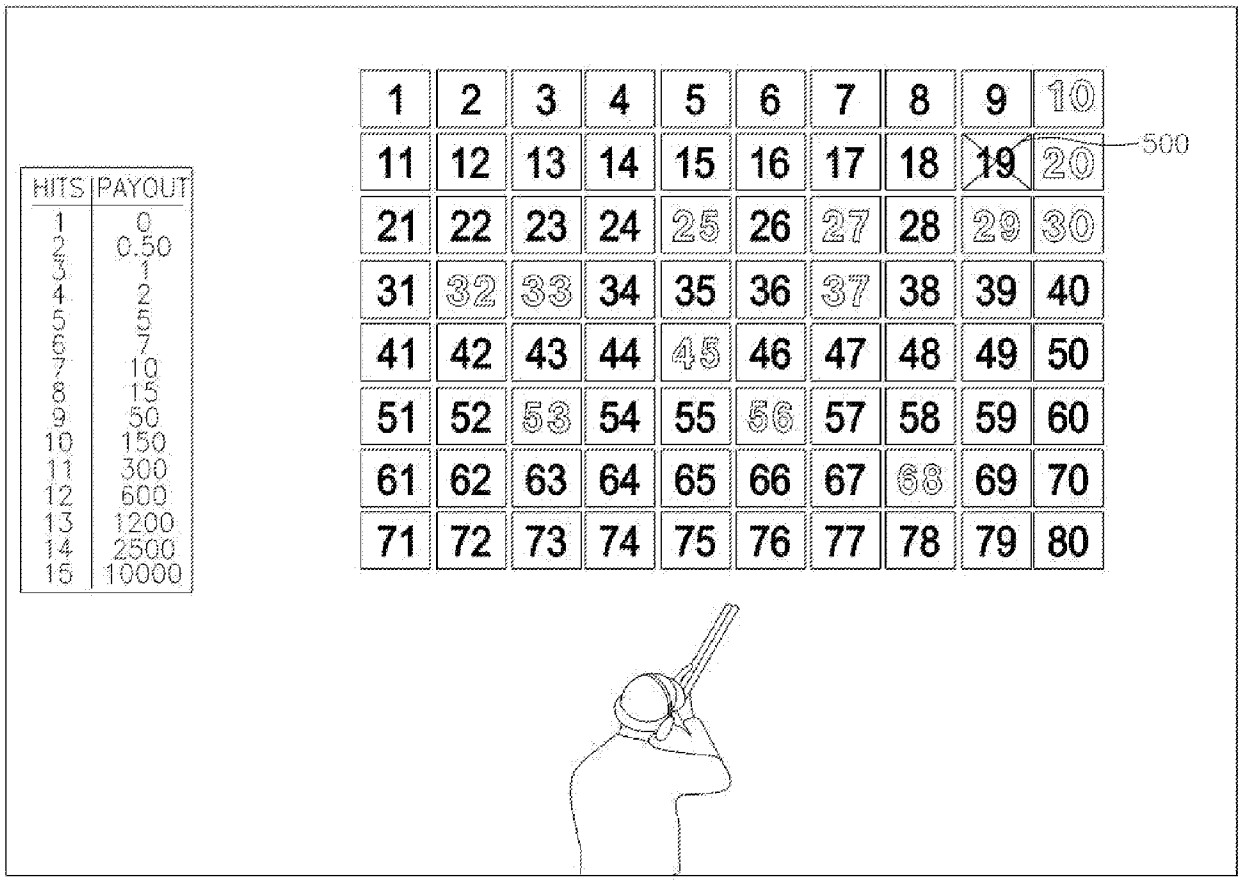
FIG. 5 is a screen shot illustrating a marked number after a projectile collision, according to an embodiment.
Figure 6:
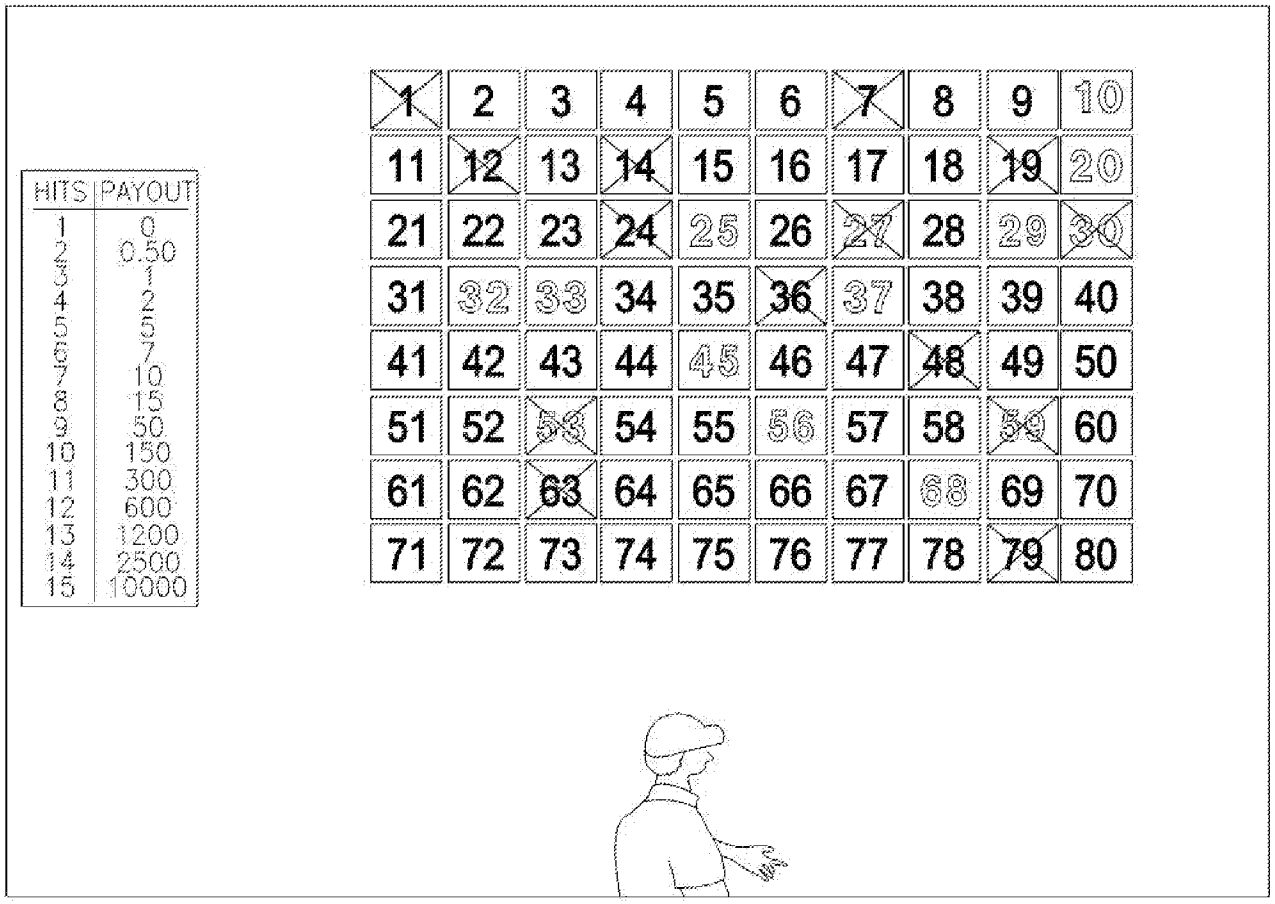
FIG. 6 is a screen shot illustrating a number grid after all randomly generated numbers are marked, according to an embodiment.

FIG. 5 is a screen shot illustrating a marked number after a projectile collision, according to an embodiment. Note the projectile collides (using animation) with number 19 (after the skeet shooter "shoots" the projectile) and then the projectile disappears. Number 9 is now marked such that it is clear to the player that 19 is one of the randomly generated numbers (in this example it is marked with an 'X' although any other type of marking will do). The player did not select number 19 as one of the player's picks, so 19 is not a match. The computer will generate 15 (or any other number) of random numbers, and each random number will have its own projectile which will be launched and animated to collide with its respective number. FIG. 6 is what a completed screen will look like after all of the computer's random numbers have been identified in this manner.

FIG. 6 is a screen shot illustrating a number grid after all randomly generated numbers are marked, according to an embodiment.

Note that there are five matches (14, 27, 30, 53, 59). Using the displayed paytable, five matches means that the player wins 7:1 (or $7 off a $1 bet). Of course the paytable illustrated is merely exemplary, and any other paytable can be used as well.

Figure 7:
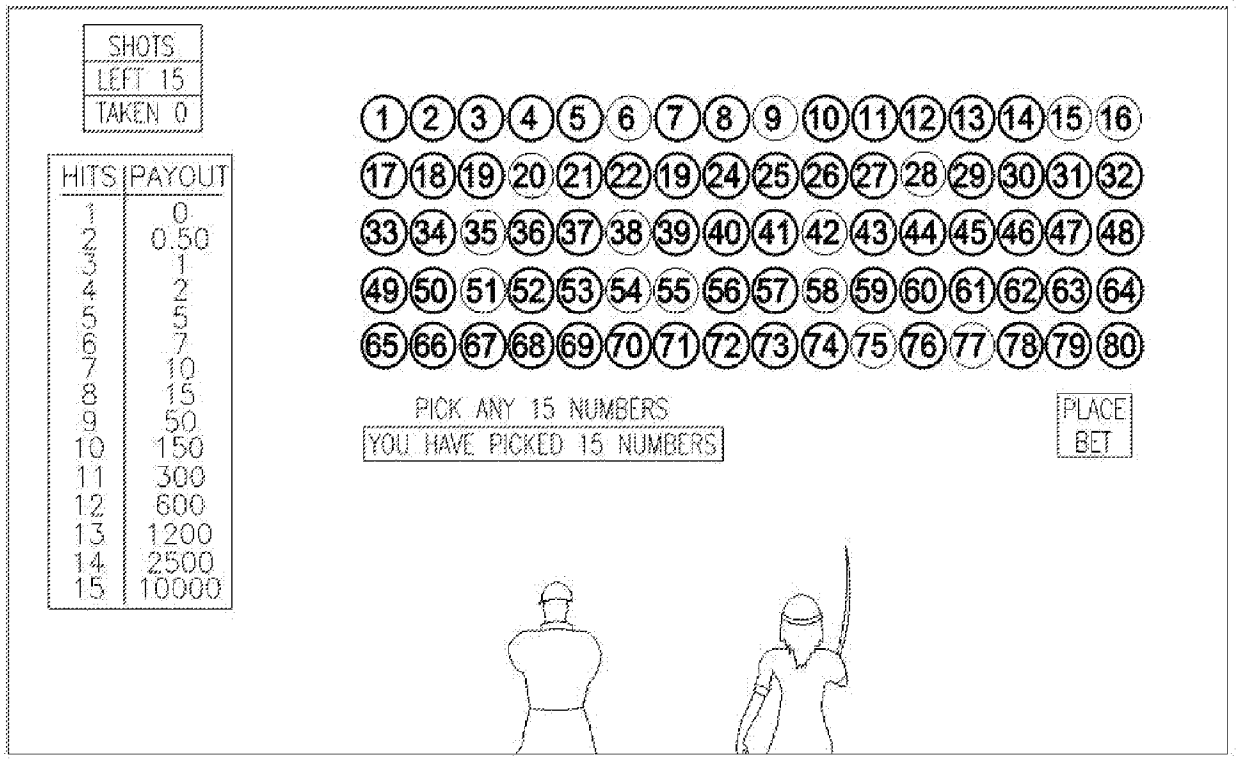
FIG. 7 is a screen shot illustrating a number grid with a fishing theme, according to an embodiment.

FIG. 7 is a screen shot illustrating a number grid with a fishing theme, according to an embodiment.

The player has picked 15 numbers. The numbers that the player has picked are shown lit up, while the numbers that the player did not pick are shown darker. The player then presses the "place bet" button to indicate to the game that the player has finished making his or her selections, upon which animation of the scene progresses to FIG. 8.

Figure 8:
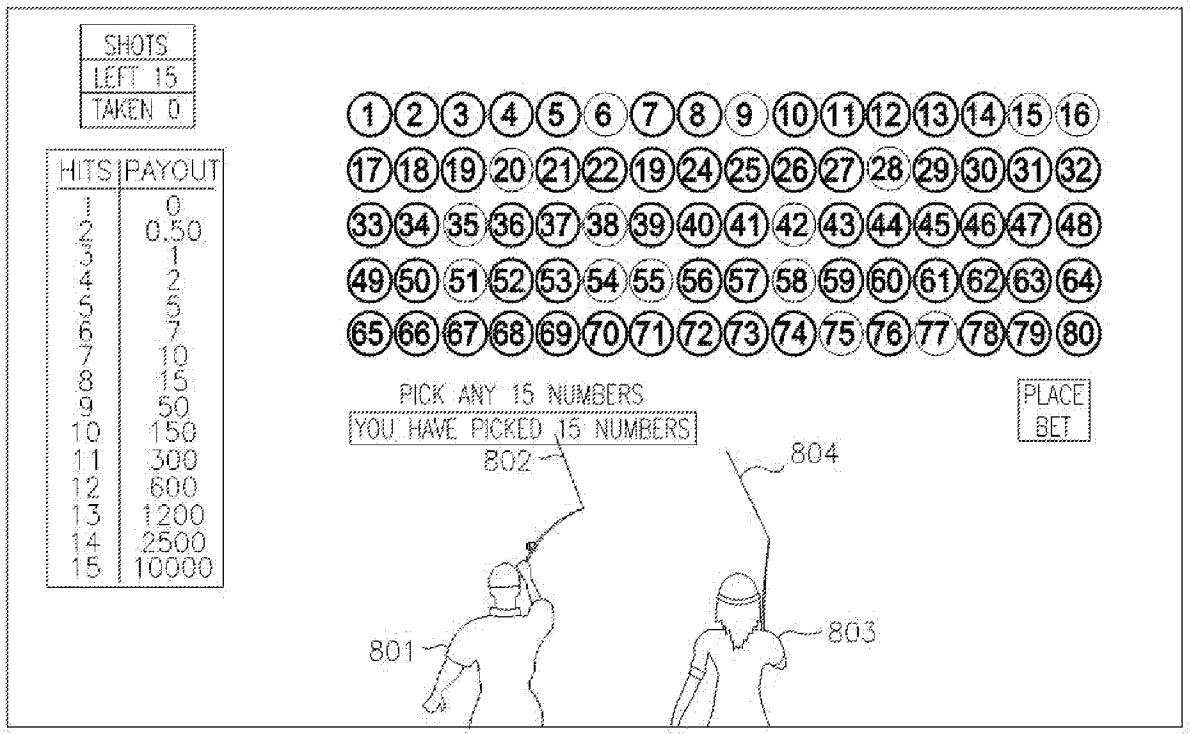
FIG. 8 is a screen shot illustrating a number grid while projectiles are being animated towards their respective targets, according to an embodiment.

FIG. 8 is a screen shot illustrating a number grid while projectiles are being animated towards their respective targets, according to an embodiment.

A first fisherman 801 has a first fishing line 802 moving towards number 2 on the grid. A second fisherman 803 has a second fishing line 804 moving towards number 9 on the grid. The fishing lines continue to animate and then strike numbers 2 and 9 to display FIG. 9. Each animation may take about one second (or any other amount of time) from the start of the projectile's motion (the fisherman) to the number on the grid. In this example, the animation for each of the fisherman appears simultaneously, although they can also be displayed sequentially (one at a time) as well. The animation animates the fishing line from the starting point (each respective fisherman) to the respective number on the grid. After each fish line reaches its target, a new animations starts over until all of the computer random numbers are marked.

Figure 9:
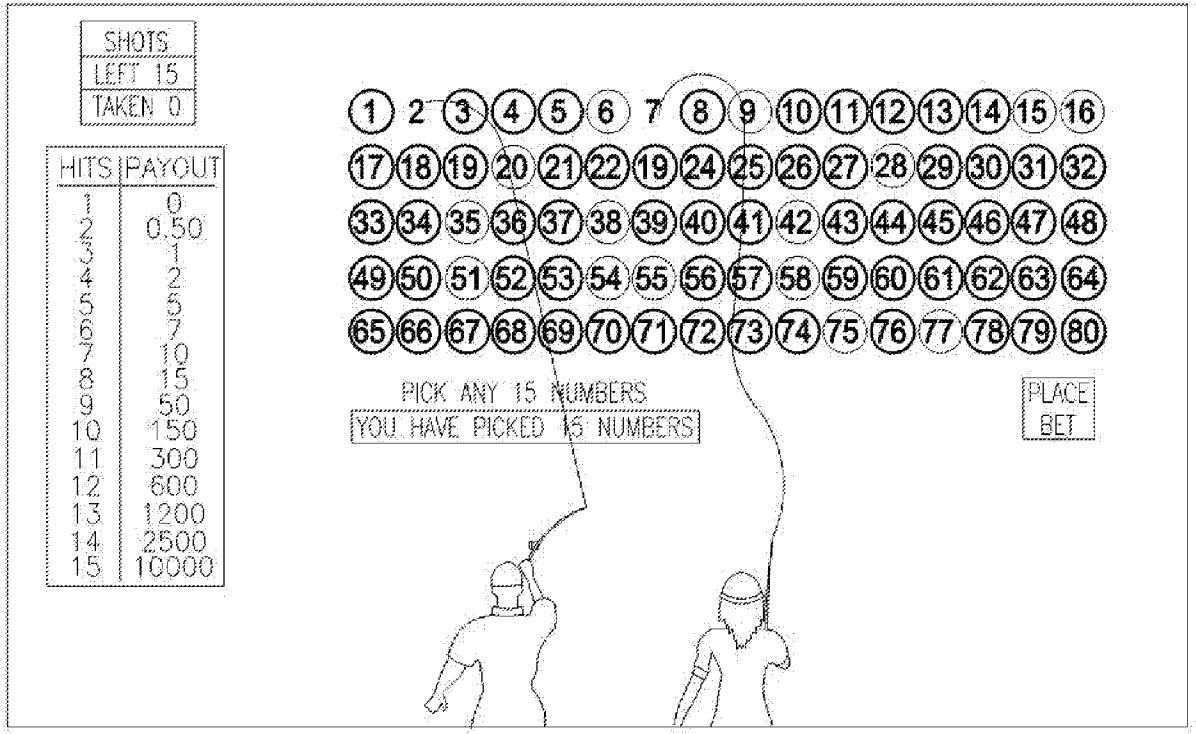
FIG. 9 is a screen shot illustrating a number grid with some picked numbers marked, according to an embodiment.

FIG. 9 is a screen shot illustrating a number grid with some picked numbers marked, according to an embodiment.

Number 2 has been hit by the fishing line from the first fisherman, while number 9 has been hit by the fishing line from the second fisherman. Numbers 2 and 9 have a different appearance than the rest of the numbers in the grid to indicate that they have been marked as numbers selected by the computer. If the animations results in a match (the projectile (fishing line) hits a number that was selected by the player), then that respective number can be marked with an 'X' (not pictured), or any other marking, to indicate that that number was picked both by the player and by the computer. For example, if a fishing line hits number 77 (which was selected by the player), then the number 77 can then be marked with an 'X' so that the player can easily see which numbers are matches. Note the curved trajectories of the fishing lines in their path from the fishermen to their respective numbers (2 and 9). The curved trajectories give a more realistic effect.

Figure 10:
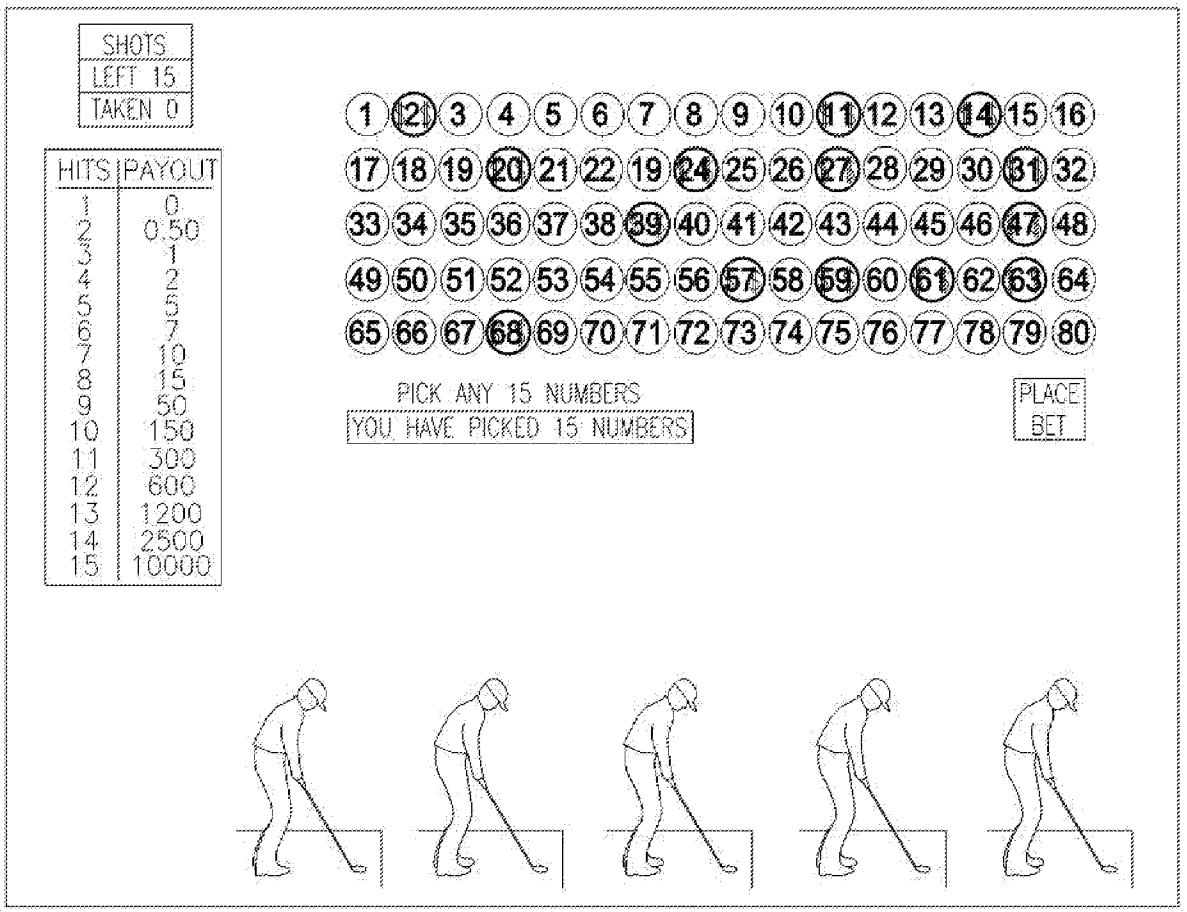
FIG. 10 is a screen shot illustrating a number grid with a golf theme, according to an embodiment.

FIG. 10 is a screen shot illustrating a number grid with a golf theme, according to an embodiment.

The player has selected 15 numbers on the grid, which are identified by their darker appearance. When the player is done selecting his or her numbers, the player can indicate that the player wishes to computer to display the computer's generated numbers by pressing a button (not pictured), which progresses the game to eventually display FIG. 11.

Figure 11:
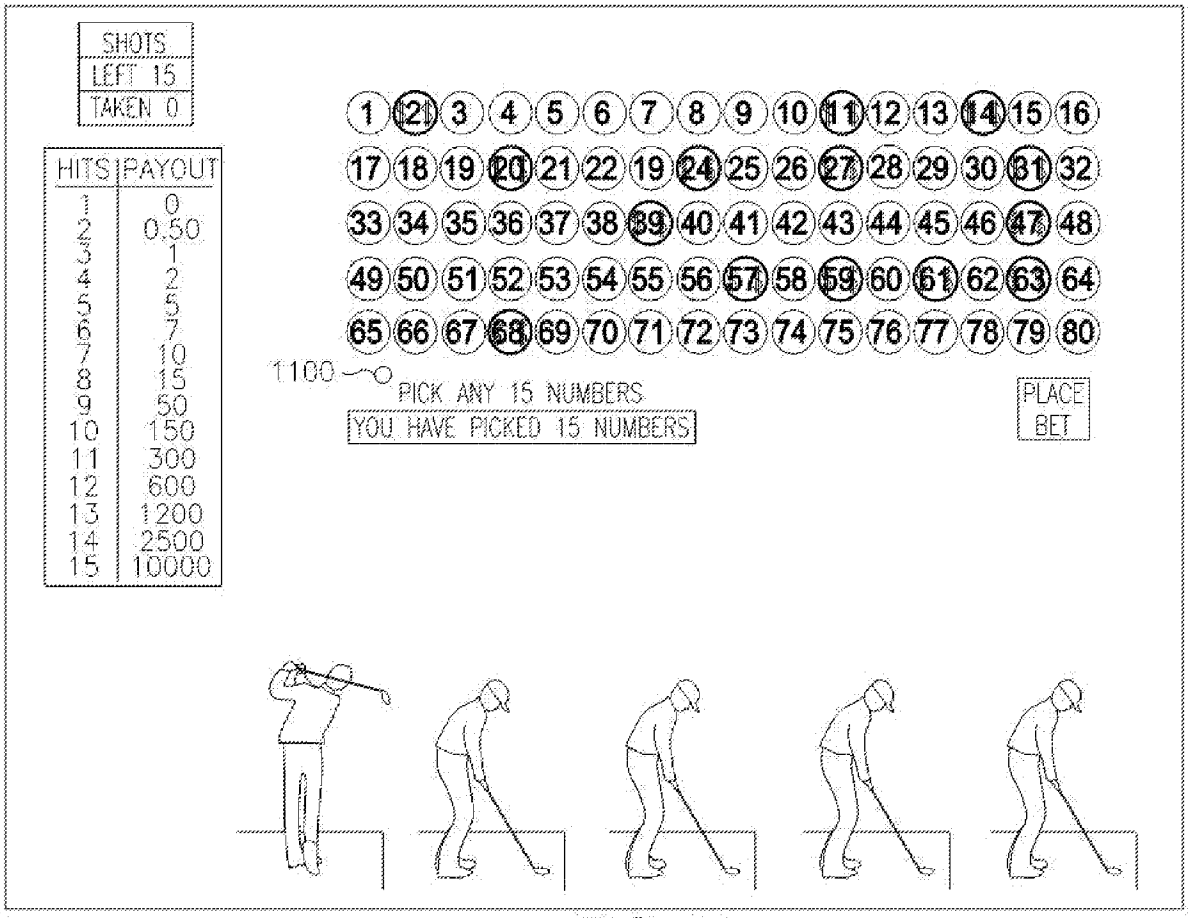
FIG. 11 is a screen shot illustrating a number grid with a projectile being animated, according to an embodiment.

FIG. 11 is a screen shot illustrating a number grid with a projectile being animated, according to an embodiment.

A projectile 1100 (golf ball) is hit by a leftmost golfer and is heading for number 66. The projectile 1100 is animated to illustrate a curved (parabolic) path, similar to a path that a real golf ball would take. The animated projectile 1100 starts at a starting point which is the leftmost golfer (more particular the point where the leftmost golfer's club strikes the ball initially) when the leftmost golfer hits the ball, and the ball continues moving in an arc to hit its respective number on the number grid (representing one of the computer generated random numbers). The animation continues to eventually display FIG. 12.

Figure 12:
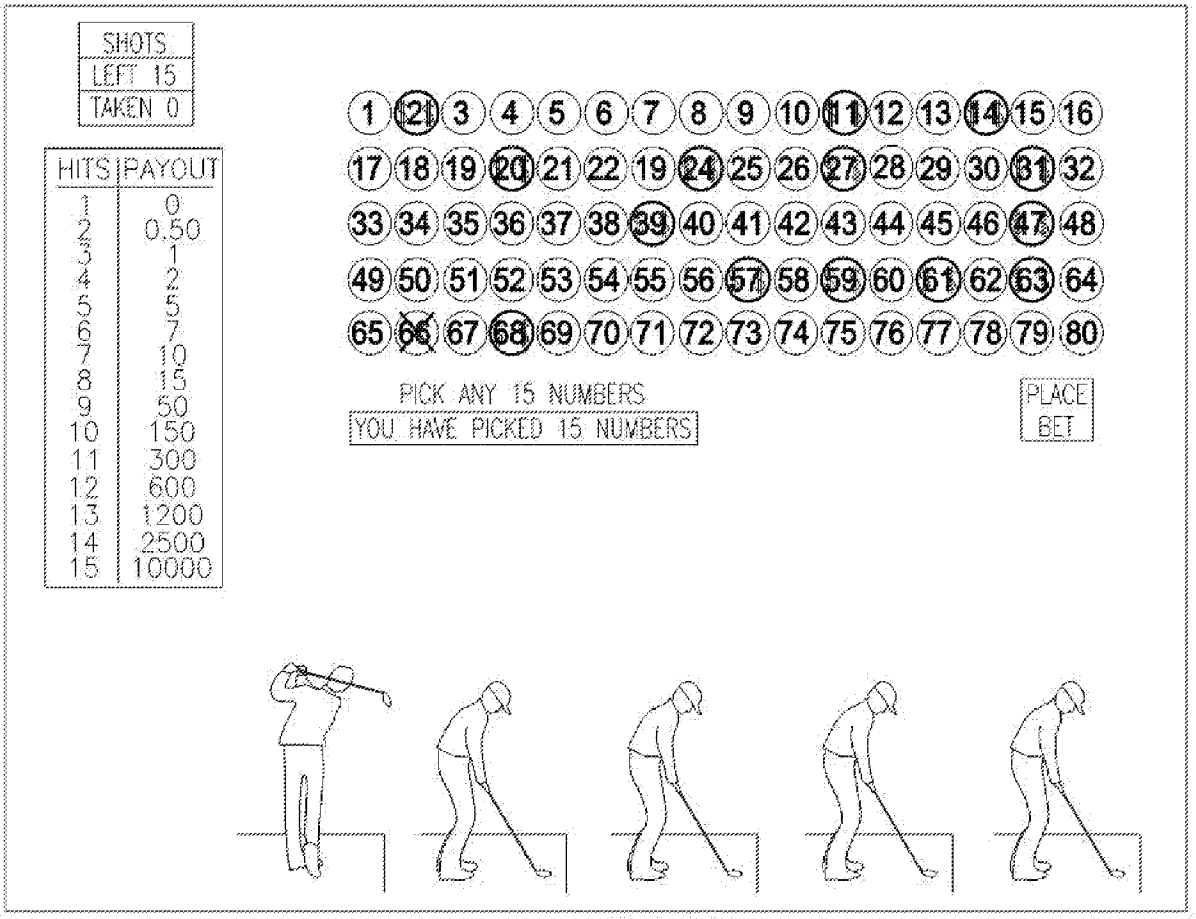
FIG. 12 is a screen shot illustrating a number grid with a randomly generated number marked after a collision with the projectile, according to an embodiment.

FIG. 12 is a screen shot illustrating a number grid with a randomly generated number marked after a collision with the projectile, according to an embodiment.

The golf ball has collided with number 66 in the grid. Number 66 is now marked with an 'X' to indicate that it was one of the computer's random numbers. Thus numbers with an 'X' that have a white background are not matches (since the player did not select these numbers), while numbers marked with an 'X' that have a dark (black/brown) background are matches (since both the player selected these numbers and the computer selected these numbers).

Thus, all of the computer generated random numbers are disclosed to the player in this manner, that is, wherein a golf ball is sequentially hit by a golfer to collide with the respective number which is then marked accordingly. Multiple golfers can also hit the balls simultaneously as well (thus, if there are five golfers and each of the five golfers hits his ball at the same time, each golfer need only hit three balls to hit a total of 15 balls to indicate the 15 randomly generated numbers).

Figure 13:
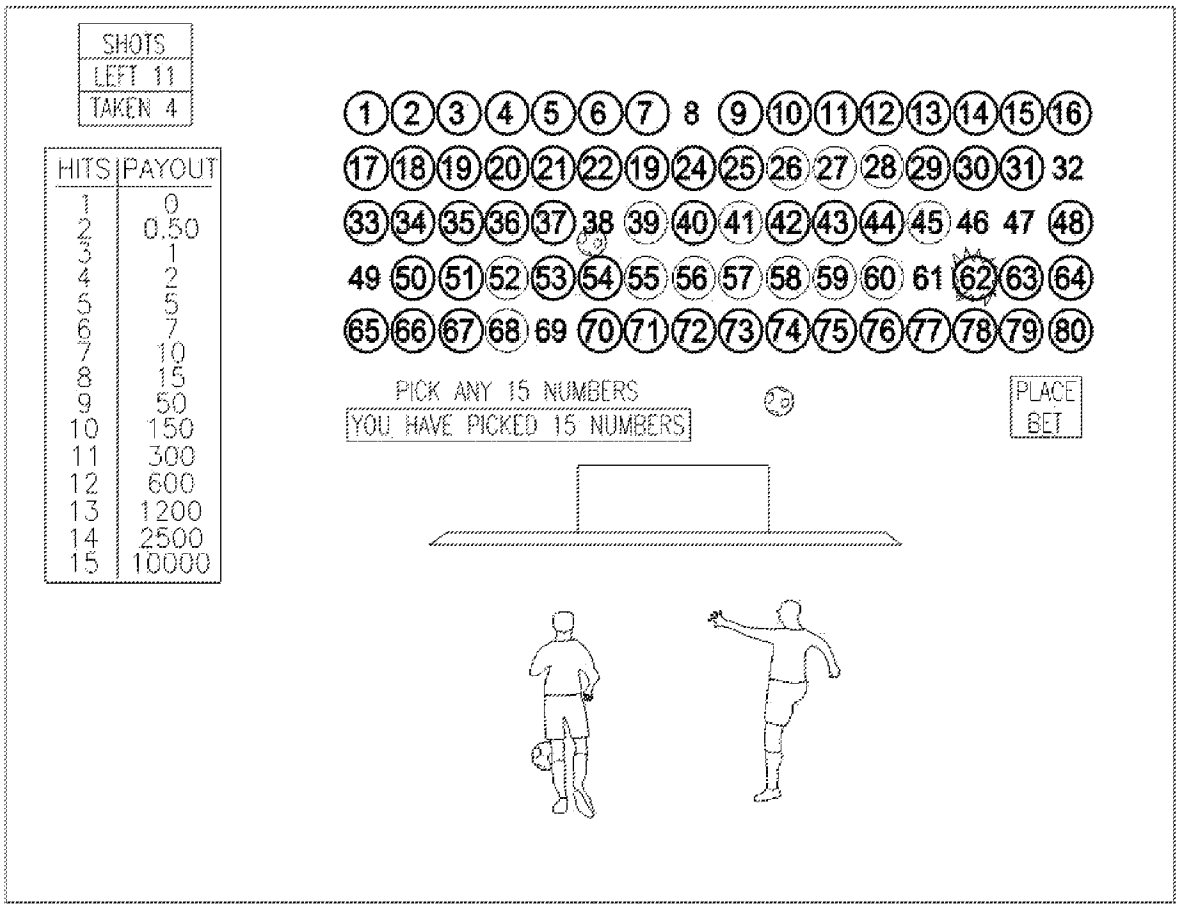
FIG. 13 is a screen shot illustrating a number grid with a soccer theme, according to an embodiment.

FIG. 13 is a screen shot illustrating a number grid with a soccer theme, according to an embodiment.

The soccer theme operates similarly to the other themes illustrates herein. Soccer players on the bottom launch projectiles (soccer balls) which will be animated in a curved path to collide with numbers in the grid in order to illustrate to the player which numbers are selected by the computer. In fact, most any sports theme can be used with the methods described herein. Other examples are baseball batters can hit baseballs to collide with numbers on the grid, basketball players can shoot basketballs to collide with numbers on the grid, etc.

An example of the methods described herein will now be presented. The player deposits a $1 wager. The player now picks 15 numbers by touching numbers on a grid, the player decides to pick numbers: 1, 2, 3, 4, 5, 6, 7, 8, 9, 10, 11, 12, 13, 14, 15. The player picked numbers are marked on the grid to indicate that they were selected by the player. The player indicates to the machine that he or she is done picking his or her numbers and wants the computer to now pick the randomly generated numbers by pressing a button. After the player presses the button, the computer now picks 15 (but this could be another number as well) random numbers. Using the theme illustrated in FIG. 13, the soccer players kicks balls to reach each of the computer selected randomly generated numbers. For example, assume the computer had picked the following random numbers: 10, 14, 43, 55, 8, 1, 20, 30, 35, 40, 41, 42, 50, 47, 50. The leftmost soccer player will kick a ball to reach the number 10 in the grid and will mark number 10 as being a computer selected number. Number 10 will also be specially marked (e.g., with an "X") to indicate that it is a matched number (picked both by the player and the computer). The rightmost soccer player will kick a ball to reach the number 14 which will be marked as a computer picked number, and will also be specially marked to indicate that this is a matched number. The leftmost soccer player will then kick a ball to reach the number 43, which will be marked to indicate that it is a computer generated number, but it will not be specially marked to indicate it is a matched number since the player did not pick number 43. The rightmost soccer player will now kick a ball which hit the number 55, which will be marked to indicate that it is a computer generated number but it will not be specially marked to indicate that it is a matched number. All 15 of the computer picked numbers (10, 14, 43, 55, 8, 1, 20, 30, 35, 40, 41, 42, 50, 47, 50) will be sequentially identified to the player in this manner. After the computer generated numbers are identified to the player, the number of matched numbers are tabulated. There are four matched numbers. According to the paytable displayed, the player gets paid $0.75 (a net loss of $0.25 since the player initially bet $1). If instead the player had matched 0 numbers, the player would have gotten paid $0 and had a net loss of $1 since the player initially bet $1. Of course, the keno payouts illustrated herein are merely exemplary, and the actual paytable used for the keno game is not important to the methods described herein.

Table I below illustrates an exemplary 15 spot keno paytable. Once again, such paytable are illustrated for exemplary purposes and the paytable is not important to the actual presentation of the game as described herein.

TABLE I

| Bet | Hits | Payout A |
|---|---|---|
| 1 | 0 | 0 |
| | 1 | 0 |
| | 2 | 0 |
| | 3 | 0 |
| | 4 | 0 |
| | 5 | 0 |
| | 6 | 1 |
| | 7 | 7 |
| | 8 | 21 |
| | 9 | 100 |
| | 10 | 400 |
| | 11 | 2,000 |
| | 12 | 8,000 |
| | 13 | 12,000 |
| | 14 | 25,000 |
| | 15 | 30,000 |

Figure 14:
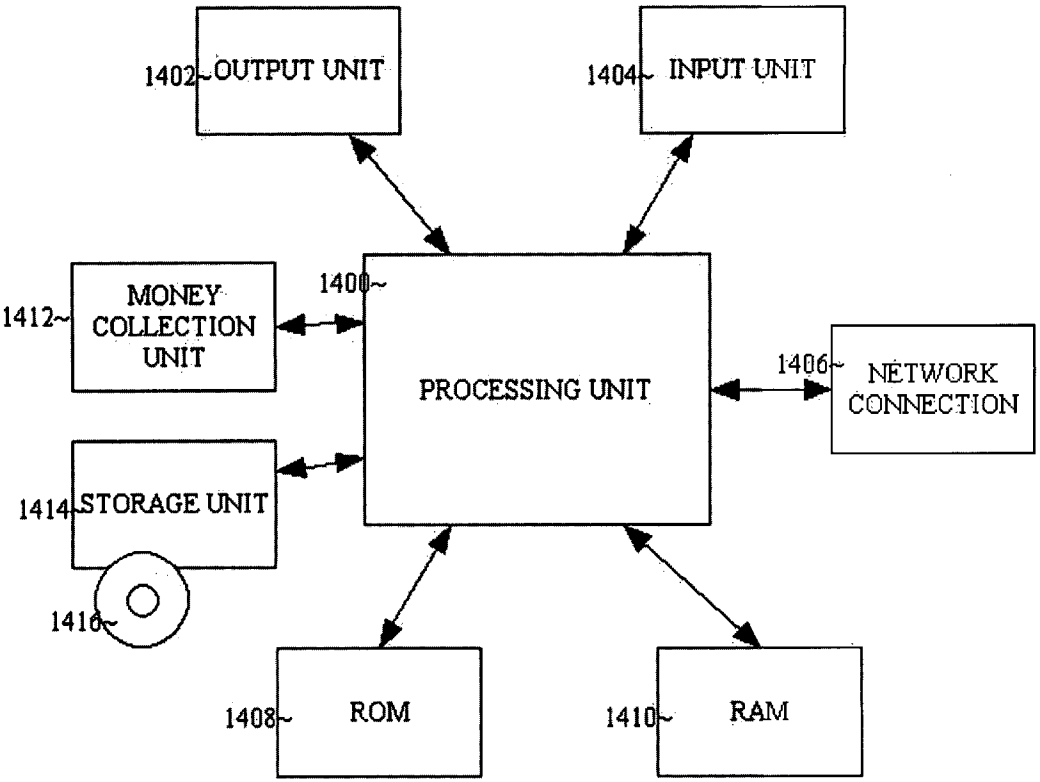
FIG. 14 is a block diagram illustrating hardware components that can be used to implement the methods described herein, according to an embodiment.

FIG. 14 is a block diagram illustrating hardware components that can be used to implement the methods described herein, according to an embodiment.

A processing unit 1400 can be a microprocessor and any related apparatus (e.g., cache, etc.) the processing unit 1400 can be connected to an output unit 1402, which can be a touch screen monitor, LCD display, CRT, etc The processing unit 1400 can also be connected to an input device 1404 which can be a touch screen monitor, buttons, keyboard, computer mouse, etc. The processing unit 1400 can also be connected to a network connection 1406 which can connect the apparatus to a LAN, Internet, WAN, or any other kind of network. The processing unit 1400 can also be connected to a RAM 1410, a ROM 1412, a money collection unit 1412 which can be used to receive cash and pay out awards in coin or a cashless ticket. The processing unit 1400 can also be connected to a storage unit 1414 which can store data necessary to implement the game on a computer readable storage medium 1416 such as a CD-ROM, DVD, hard disk, etc.

In addition to keno, the methods described herein can also be applied to any lottery type game wherein random numbers generated by a computer are disclosed to the player. Using the methods described herein will result in a more exciting lottery game than a standard lottery game that simply displays the winning numbers to the player.

It is noted that all of the operations described herein can be performed in any order. Any operation can also be optional. Wagers can be placed and resolved in any sensible order. All communications with an electronic gaming device can be effectuated using a touch screen (or any other input/output method) using a graphical user interface (GUI).

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game on a computer, the method comprising:

executing instructions on a computer to perform a following operations;

displaying a collection of numbers comprising all possible numbers on an output device controlled by the computer;

receiving a wager from a player using an input device communicating with the computer;

receiving a set of player picked numbers picked by a player from all of the possible numbers using the input device and marking the set of player picked numbers on the collection on the output device;

determining randomly a set of computer generated numbers from all of the possible numbers;

for each particular number from the set of computer generated numbers, performing:

animating a projectile from a starting point to the particular number in the collection of numbers on the output device;

completing the animating and marking the number in the collection on the output device as being one of the computer generated numbers;

determining a number of matches between the set of player picked numbers and the set of computer generated numbers; and determining if the player has earned an award based on the number of matches, and if so, then paying the award to the player, an amount of the award being based on the number of matches, wherein the animating to the particular number in the collection of numbers is performed for the set of computer generated numbers for both matches and non matches to the set of player picked numbers.

2. The method as recited in claim 1, wherein the animating uses a trajectory for the projectile which is determined based on the particular number in the collection.

3. The method as recited in claim 1, further comprising animating a human character playing a sport at the starting point.

4. A method to play a wagering game on a computer, the method comprising:

executing instructions on a computer to perform a following operations:

displaying a collection of numbers comprising all possible numbers on an output device controlled by the computer;

receiving a wager from a player using an input device communicating with the computer;

receiving a set of player picked numbers picked by a player from all of the possible numbers using the input device and marking the set of player picked numbers on the collection on the output device;

determining randomly a set of computer generated numbers from all of the possible numbers;

for each particular number from the set of computer generated numbers, performing:

determining a starting point for a respective projectile for the particular number by alternating from different predetermined starting points;

animating the projectile from the starting point to the particular number in the collection of numbers on the output device;

completing the animating and marking the number in the collection on the output device as being one of the computer generated numbers;

determining a number of matches between the set of player picked numbers and the set of computer generated numbers; and determining if the player has earned an award based on the number of matches, and if so, then paying the award to the player, an amount of the award being based on the number of matches, wherein the animating to the particular number in the collection of numbers is performed for the set of computer generated numbers for both matches and non matches to the set of player picked numbers.

5. The method as recited in claim 4, wherein the animating uses a trajectory for the projectile which is determined based on the particular number in the collection.

6. The method as recited in claim 1, further comprising animating a human character playing a sport at the different predetermined starting points.

7. An apparatus to play a wagering game, the apparatus comprising:

a processing unit configured to execute instructions configured to perform:

displaying a collection of numbers comprising all possible numbers;

receiving a wager from a player;

receiving a set of player picked numbers picked by a player from all of the possible numbers and marking the set of player picked numbers on the collection;

determining randomly a set of computer generated numbers from all of the possible numbers;

for each particular number from the set of computer generated numbers, performing:

animating a projectile from a starting point to the particular number in the collection of numbers;

completing the animating and marking the number in the collection as being one of the computer generated numbers;

determining a number of matches between the set of player picked numbers and the set of computer generated numbers;

determining if the player has earned an award based on the number of matches, and if so, then paying the award to the player, an amount of the award being based on the number of matches; and an output unit to display outputs of the processing unit, wherein the animating to the particular number in the collection of numbers is performed for the set of computer generated numbers for both matches and non matches to the set of player picked numbers.

8. The apparatus as recited in claim 7, wherein the processing unit is further configured such that the animating uses a trajectory for the projectile which is determined based on the particular number in the collection.

9. The apparatus as recited in claim 7, wherein the processing unit is further configured to perform: animating a human character playing a sport at the starting point.

10. The apparatus as recited in claim 7, wherein the processing unit is further configured such that the animating a projectile for each particular number is performed sequentially.

11. The apparatus as recited in claim 7, wherein the processing unit is further configured such that the animating a projectile for different particular numbers is performed simultaneously.

* * * * *